US006354447B1

(12) United States Patent
Brown

(10) Patent No.: US 6,354,447 B1
(45) Date of Patent: Mar. 12, 2002

(54) FINGERNAIL COLOR DISPLAY DEVICE

(75) Inventor: Shahnaz Mir Brown, 11113 Crater Dr., San Diego, CA (US) 92126

(73) Assignee: Shahnaz Mir Brown

( * ) Notice: Subject to any disclaimer, the term of this patent is extended or adjusted under 35 U.S.C. 154(b) by 0 days.

(21) Appl. No.: 09/161,041

(22) Filed: Sep. 25, 1998

Related U.S. Application Data

(60) Provisional application No. 60/061,274, filed on Oct. 7, 1997.

(51) Int. Cl.[7] ..... A47F 7/00; A45D 29/00

(52) U.S. Cl. ..... 211/60.1; 211/18.1; 211/70.6; 132/73; D28/61

(58) Field of Search ..... 211/60.1, 69, 85.2, 211/13.1, 70.6; 63/42; 132/73; 269/296, 43; D28/61

(56) References Cited

U.S. PATENT DOCUMENTS

| | | | | | |
|---|---|---|---|---|---|
| 648,928 | A | * | 5/1900 | Davis | 211/60.1 X |
| D46,656 | S | * | 11/1914 | Hamberger | 211/69 X |
| 1,942,332 | A | * | 1/1934 | Hamberg | 63/42 |
| 2,305,021 | A | * | 12/1942 | Meier | 211/69 X |
| 3,638,664 | A | * | 2/1972 | Cohn | 211/60.1 X |
| 4,880,122 | A | * | 11/1989 | Martindell | 211/69 X |
| 4,966,288 | A | * | 10/1990 | Kirkham | 211/60.1 |
| 5,141,117 | A | * | 8/1992 | Olsen et al. | 211/60.1 X |
| 5,190,169 | A | * | 3/1993 | Sincock | 211/60.1 |
| 5,823,363 | A | * | 10/1998 | Cassel | 211/60.1 |
| 5,904,149 | A | * | 5/1999 | Ruhl et al. | 211/13.1 X |

* cited by examiner

*Primary Examiner*—Jerry Redman
*Assistant Examiner*—Erica B. Harris

(57) ABSTRACT

A display device having pops with fingernail portions. Each pop is the same, and is held by a display portion.

4 Claims, 4 Drawing Sheets

FINGERNAIL COLOR DISPLAY DEVICE

This application claims benefit of Provisional No. 60/061,274 filed Oct. 7, 1997.

FIELD

The present invention describes a fingernail display device with separable display elements which are displayable in a case, arrangable so that all can be seen, and removable for inspection.

BACKGROUND

Fingernail polish comes in many different colors and shades. Choice of the proper color is often based on many factors, including the way in which the color interacts with the person's skin color. The color of nail polish can look very different in the bottle than it does on the fingernails.

SUMMARY

The present disclosure describes a system of displaying nail polish colors on sample fingernail display elements. Those elements are formed of artificial nail materials. One aspect includes displaying those samples in a way that allows them all to be seen at once and also allows any of these elements to be removed for inspection.

DESCRIPTION OF THE EMBODIMENTS

Figure 1:
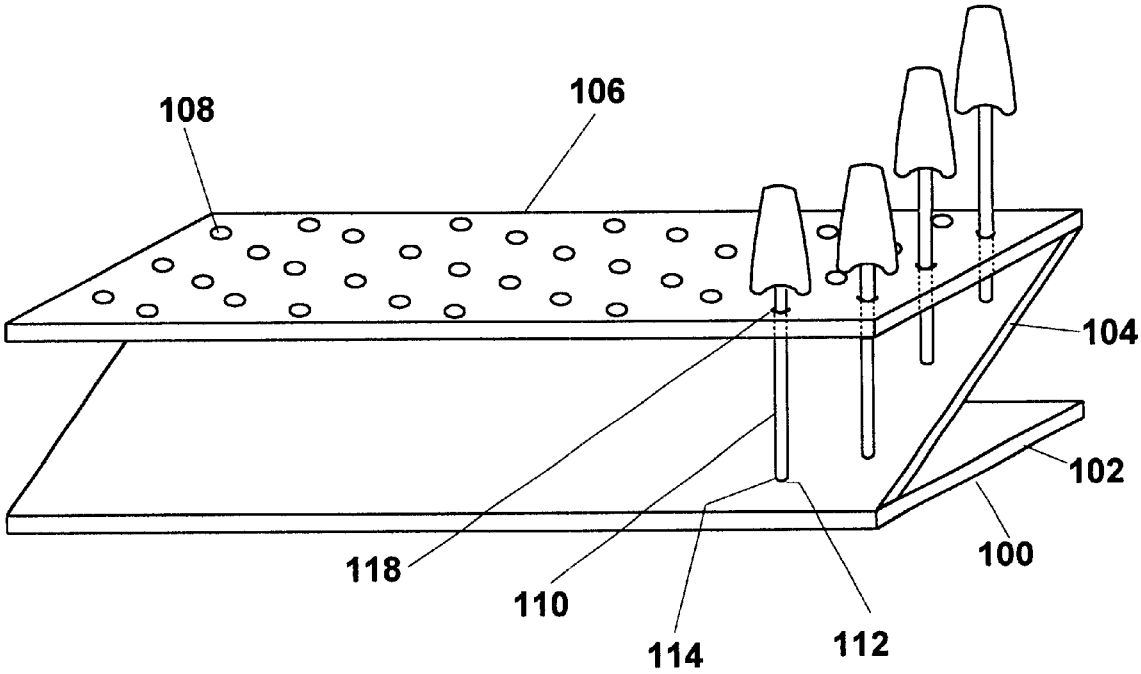
FIG. 1 shows the overall nail display device.

FIG. 1 shows a self-standing device 100 of the preferred embodiment. The device is formed from a single piece of acrylic folded into a configuration that has a substantially z-shaped cross section. The resulting device has a base section 102, a holding section 106, and a stop section 104.

The holding section 106 is formed with a plurality of holes 108 arranged generally in an array. The array is preferably a regular array with straight-line rows and columns. The straight lines of the rows are parallel to the front surface of the holding section, and the columns are parallel with the side surface of the holding section.

A plurality of pops 110 are sized and configured to fit within holes in the holding surface 106. The holes extend through the holding surface from a first side facing away from the stop section 104, to the bottom side facing the stop section 104. The stop section 104 forms a stopper surface, below the holding surface. The bottom surface of each of the holes 108 faces the stop surface. The stop surface can be perfectly flat, or it can include partial holes drilled therein, "divets", to maintain the pops better into position.

Figure 2:
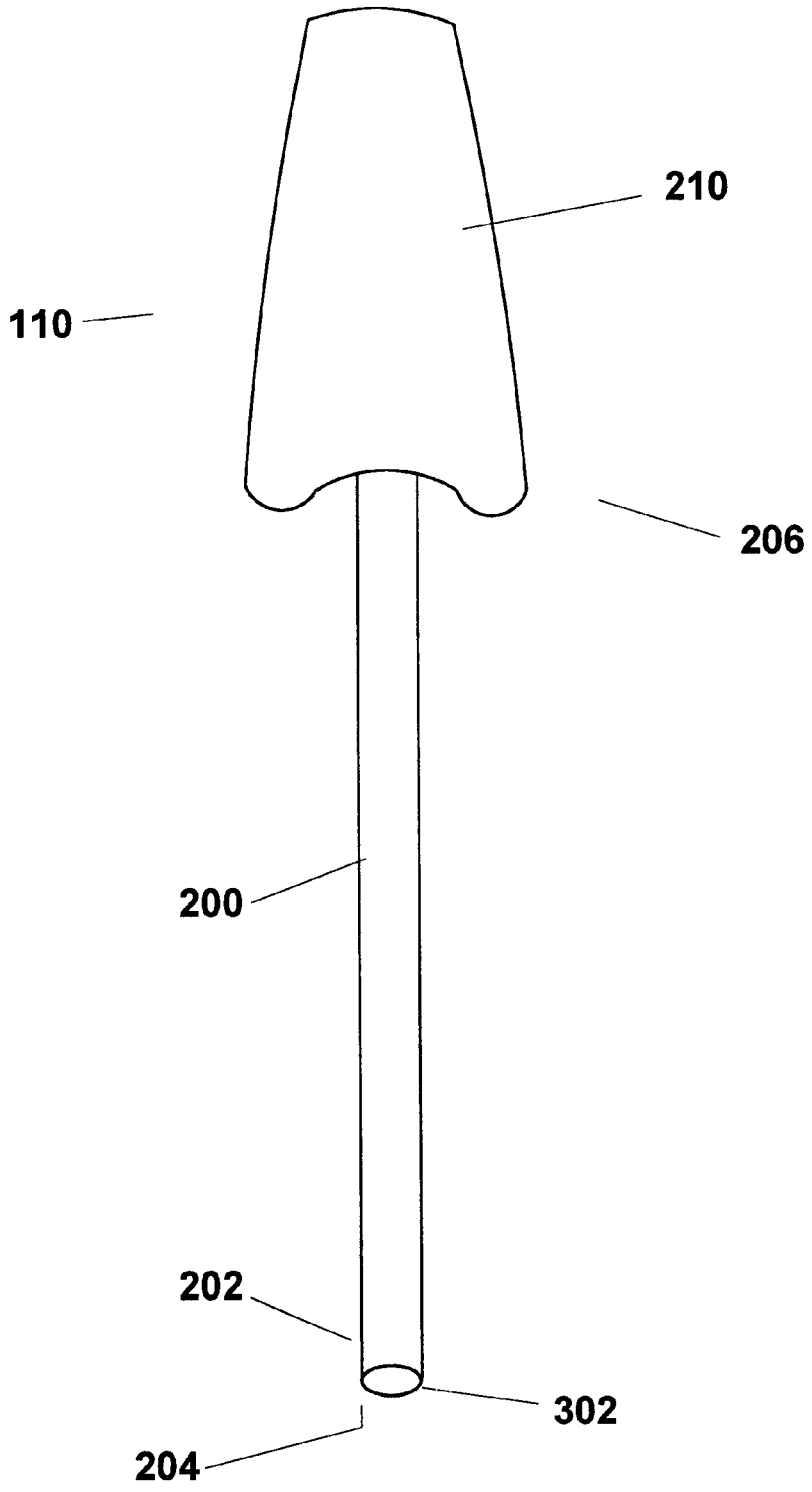
FIGS. 2 and 3 show details of the pops with artificial fingernail material.
Figure 3:
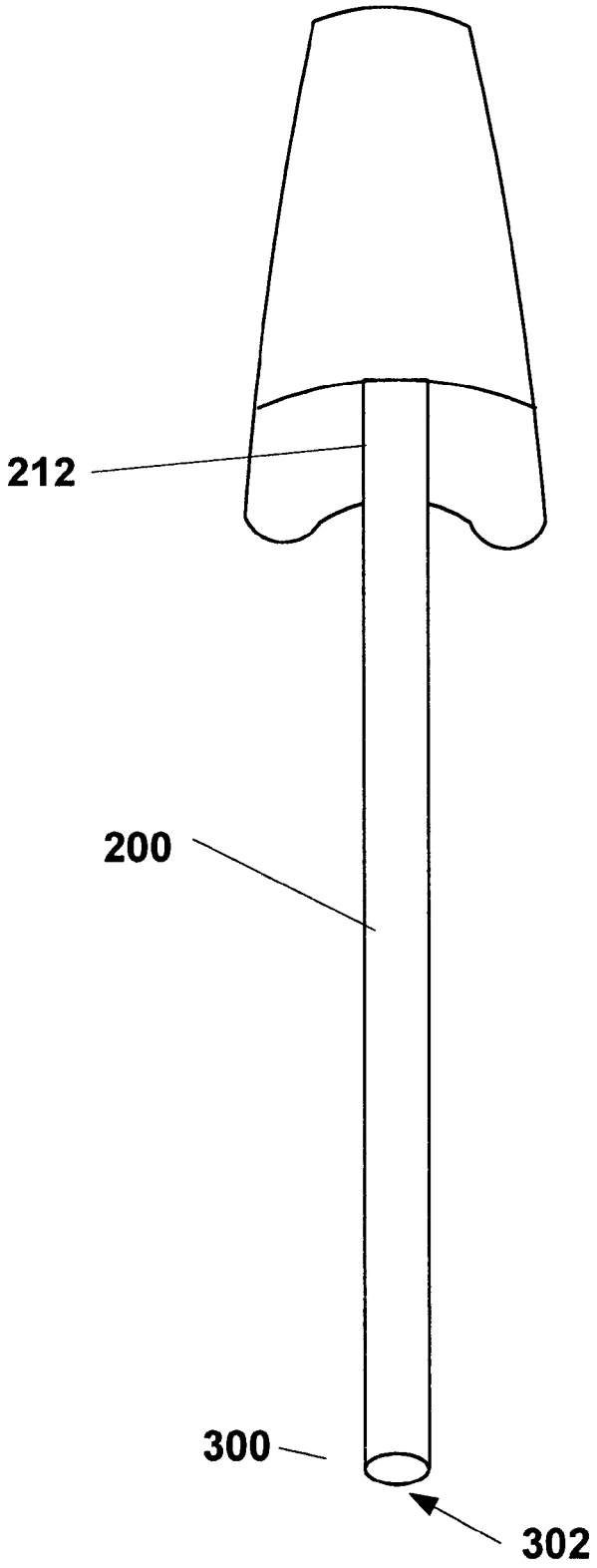

A plurality of pops such as 110 are shown in FIGS. 2 and 3. Each pop is formed of a cylindrical rod 200 formed of acrylic with an outer diameter slightly smaller than an inner diameter of each of the holes 108. Rod 200 has a distal end 202 with an end surface 204. The opposite end 206, opposite to the distal end 202, has a fingernail attachment portion 212. Fingernail attachment portion 212 is glued to a fake fingernail 210, of the type that is used for attachment to fingernails. Fingernail portion 210 is glued to cylindrical rod 200 at an attachment portion 212. This forms a lollipop type shaped device, with a cylindrical rod that can be held, and an attached fingernail portion. While holding the cylindrical rod, the fingernail portion can be placed against the user's finger in order to view the differently-colored nails against the user's actual skin tone.

In the preferred embodiment, each of the pops 110 has a same height cylindrical rod, where the height of the pop is defined as the distance between the end surface 204 and fingernail attachment portion 212. When the pops 110 are placed in the nail display device, the bottom end surfaces 204 each press against the stop surface 104. Since the stop surface is tilted relative to the horizontal holding section and base section, the rows of pops attain a staggered effect to the rows, as shown. The front-most rows are held lower than the rear rows. Since the rear row is higher, its view is not blocked by the front row, and the rear rows can hence be viewed from the front of the device without obstruction.

All rows can be seen from the front of the unit without obstruction from the rows in front of the rear rows. FIG. 1 shows each row being progressively higher than the row in front of that row.

An alternative embodiment uses different height rods to produce the staggered height display. However, the same-height rods are preferred, since this allows any of the pops to be located in any of the different rows.

The end surfaces 204 of the rods are pressed against the stop surface 104. Since the unit is preferably formed of Lucite, the inventor recognized that these end surfaces 204 could scratch the Lucite material . Therefore, the end surfaces of the rods are preferably formed with a scratch prevention feature. The preferred mode uses a rounded bottom surface 300 so that an outer tangent point of the outermost meniscus 302 of the bottom surface touches the stop surface 104. Therefore no sharp edges will touch the stop surface.

Figure 4C:
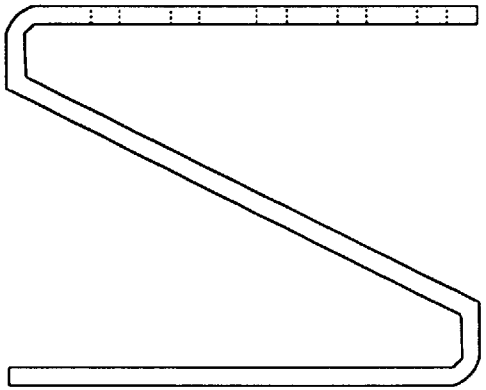
FIGS. 4A–4C respectively show front view, top view and side view of the stand.
Figure 4A:
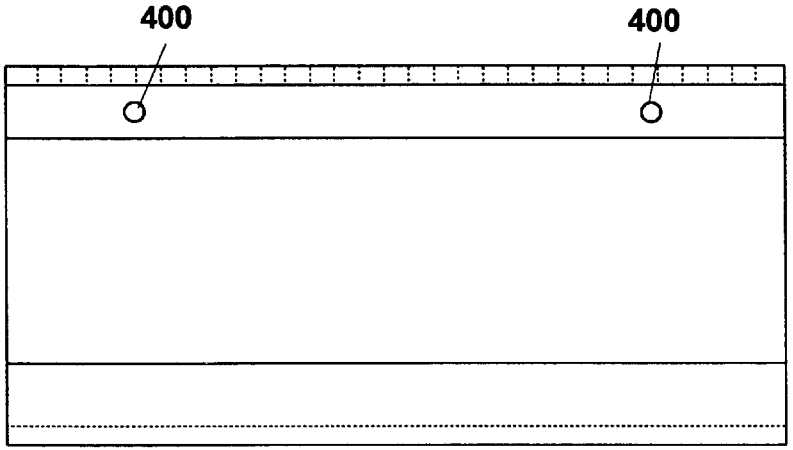
Figure 4B:
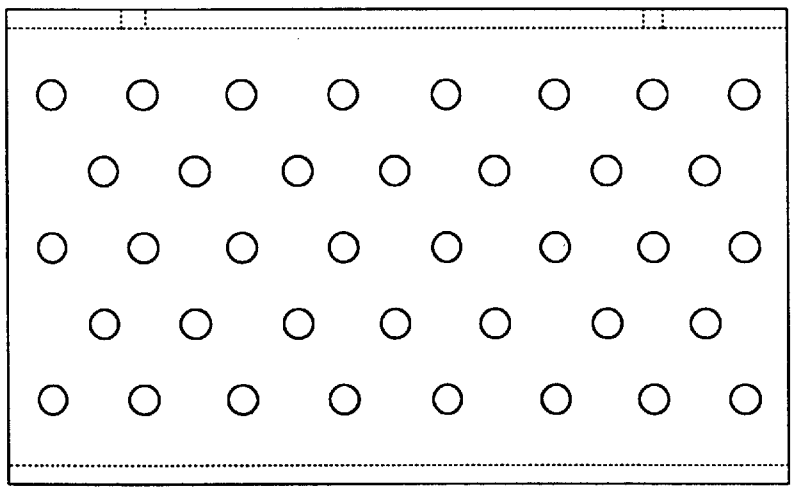

FIGS. 4A–4C respectively show front view, top view and side view of the stand. The bottom surface 102 usually forms the supporting surface that allows the unit to be placed on a flat countertop. An alternative wall mounting of the the stand is also possible. Holes 400 are provided for allowing wall mounting of the stand. This allows the surface with holes 400 to form the supporting surface. If the stand is wall mounted, the the bottom panel can be removed.

Many modifications are possible. For example, the rod portion 200 can have a different shape, such as triangular or pentagonal. The holes in the holding surface 106 would then preferably be of the same outer shape. The stand 100 could be of other shapes. The stop surface could be horizontal rather than tilted, if the rods are of different lengths. The bottom panel could be replaced by two side panels.

In addition, the stop surface could be on the pops themselves, rather than on the stand. For example, the sides of the pops could be widened at a predetermined spot to form the stop surface.

All such modifications are intended to be encompassed in the following claims.

What is claimed is:

1. A fingernail display system, comprising:

a display holding device, having a supporting surface holding the device in a fixed position, a stop surface, and a display holding surface, said stop surface being tilted relative to horizontal, said display holding surface including a flat surface which is substantially parallel with horizontal, said flat surface including a plurality of holes therein, said holes arranged in an array, with a front row of holes, and at least one rearward row of holes behind said front row of holes, said holes having an inner size and extending through said display holding surface, said stop surface being below said display holding surface so that a bottom surface of said holes face said stop surface; and a plurality of display elements, each said element including a holding portion formed of an extended member having an outer shape which is substantially matched to the inner size of said holes in said flat surface, said extended member including a top portion and a bottom portion, an artificial fingernail portion attached to said top portion, each of said plurality of display elements having a portion which presses against the inner surfaces of said holes, and a distal interfacing portion, at said bottom portion, which presses against said stop surface, said display elements in said front row of said display holding device having upper parts which are lower than corresponding parts of said display elements in said rear row, wherein each of said extended members has the same length from the top portion to the bottom portion.

2. A system as in claim 1, wherein said holes are round and said extended member has a cylindrical shape.

3. A system as in claim 1, wherein said extended members have a non scratch element on said bottom portion.

4. A fingernail color display system, comprising:

a plurality of holding rods, each having a first end and a second end and a fingernail color display element connected to said first end of each of said rods; and a display device, holding said holding rods, and having a z-shape with a flat bottom portion, a flat horizontal top portion having a plurality of holes extending therethrough, said holes being arranged in a plurality of rows, and a flat first portion that is tilted relative to horizontal from front to back, and against which each of said second ends press, to display said rods in rows such that a rearmost row is higher than a frontmost row, said first portion extending between said bottom portion and said top portion.

* * * * *